US007252212B2

(12) United States Patent
Anjanappa et al.

(10) Patent No.: US 7,252,212 B2
(45) Date of Patent: Aug. 7, 2007

(54) LONG-TERM LIQUID STORAGE AND DISPENSING SYSTEM

(76) Inventors: Muniswamappa Anjanappa, 2004 Eliza Dorsey La., Ellicott City, MD (US) 21042; David T. Bach, 3311 Governer Johnson Ct., Ellicott City, MD (US) 21043; G. Steven Bova, 1000 Foll St. #510, Baltimore, MD (US) 21231; Steven L. Paul, 12804 Degwood Hills La., Fairfax, VA (US) 22033; James J. Bach, 222 Whitehall Rd., Elkton, MD (US) 21921

( * ) Notice: Subject to any disclaimer, the term of this patent is extended or adjusted under 35 U.S.C. 154(b) by 488 days.

(21) Appl. No.: 10/838,407

(22) Filed: May 3, 2004

(65) Prior Publication Data

US 2004/0256415 A1 Dec. 23, 2004

Related U.S. Application Data

(60) Provisional application No. 60/467,309, filed on May 1, 2003.

(51) Int. Cl.
*B65D 88/54* (2006.01)

(52) U.S. Cl. ..... 222/327; 604/253

(58) Field of Classification Search ..... 222/327, 222/325, 309, 1; 604/224, 253, 256, 227, 604/226, 192–193, 218–222
See application file for complete search history.

(56) References Cited

U.S. PATENT DOCUMENTS

| | | | | |
|---|---|---|---|---|
| 4,201,209 | A * | 5/1980 | LeVeen et al. | 604/218 |
| 4,363,329 | A * | 12/1982 | Raitto | 600/578 |
| 4,810,248 | A * | 3/1989 | Masters et al. | 604/192 |
| 5,411,488 | A * | 5/1995 | Pagay et al. | 604/218 |
| 6,431,743 | B1 * | 8/2002 | Mizutani et al. | 366/189 |
| 6,872,194 | B2 * | 3/2005 | Doyle et al. | 604/192 |

* cited by examiner

*Primary Examiner*—Lien M. Ngo

(74) *Attorney, Agent, or Firm*—Akerman Senterfitt; Stephan A. Pendorf; Yonghong Chen

(57) ABSTRACT

A liquid storage and dispensing system, and methods for its use in the storage, shipping, and accurate dispensing by manual or automated methods, of, for example, precious biologic samples such as protein, DNA or RNA, with minimal contamination, oxidation, and evaporation, the system having: an essentially cylindrical storage barrel with a flange at its open end and a port and delivery tip at the closed end; a piston with a seal, where the piston closely matches the shape of the closed end of the barrel to minimize dead volume; and a cover to seal the delivery tip during storage such as cryostorage.

20 Claims, 6 Drawing Sheets

LONG-TERM LIQUID STORAGE AND DISPENSING SYSTEM

CROSS-REFERENCE TO RELATED APPLICATION

This application claims the benefit of priority from Provisional Application No. 60/467,309 filed May 1, 2003, which is hereby incorporated by reference in its entirety.

FIELD OF THE INVENTION

The present invention relates to a method and device for the storage and dispensing of a liquid. More particularly, the invention relates to a device for the long-term storage and precision dispensing of fluids, such as precious biologic fluids, by manual or automated means, which minimizes contamination, diffusion, oxidation, and evaporation, and improves inventory control.

BACKGROUND OF THE INVENTION

The Human Genome Project and various new technologies linking disease phenotypes with cellular genotypes have ushered in a new era in life science research and personalized medicine. Post-genomic era research promises improved clinical diagnostics, better pharmaceutical products and individualized healthcare. Such research begins with asking a specific molecular question of multiple stored precious biologic solutions containing DNA, cDNA, RNA, protein, or other materials isolated from diseased or normal tissue. Such research therefore requires the precise handling of a large number of samples, preferably in an automated apparatus such as taught by U.S. Pat. No. 6,387,330, which is hereby incorporated in its entirety by reference.

At present, precious DNA and other biologic samples used for such studies are typically maintained in aqueous form with solvents such as pure water or Tris-EDTA at concentrations of the order of ng/μl, and are typically stored in transparent plastic microcentrifuge tubes, either individually or in racks. The precious biologic solutions are stored at temperatures of 4° C. or −20° C., with a small percentage at −80° C. or even in liquid nitrogen. Among many drawbacks of the current practice, contamination, evaporation, and lack of convenient inventory control are prominent.

A first problem is contamination. According to the prior art, each time a precious biologic sample is needed, its container is thawed, the cap is opened, and a manually directed pipette is inserted to aspirate and transfer the desired amount of solution to a separate receptacle. Manual pipetting is prone to accidental placement of a pipette tip into a wrong sample. Even a one percent contamination rate can invalidate results of all subsequent experiments in a given sample and study. Similarly, automated pipetting, which is typically done with 96-well plates, requires prior removal of either a non-sealing plastic closure or an adhesive film to access the solution, which may be repeated many times for a given sample. While removing the seal, the samples may be aerosolized through vibration of the solution, which increases the risk of cross-contamination. This is especially true, for example in 96-well plates, where the samples are close to each other.

A second problem is evaporation. Within the teachings of the prior art, the primary source of evaporation and concentration change, is a lack of robust sealing of most microcentrifuge tubes combined with prolonged air contact because tubes are typically filled to only half height to avoid spillage when inserting a pipette tip. Further, diffusion of water through plastic over long periods of time can also cause changes in concentration. Consequently, investigators often use samples whose precise concentration is unknown concentration, which increases the rate of failed, invalid, or uninterpretable results. Laboratories requiring greater quality control recheck the concentration of the samples prior to each use, a practice that is time consuming, expensive, and also wastes precious biologic materials.

A third problem is oxidation. Exposure to dissolved oxygen may oxidatively damage samples. For example, environmental oxidation of may cause strand breaks in DNA or RNA reducing its quality for subsequent analysis, or may oxidize reactive thiol groups in protein solutions, changing protein reactivity in subsequent assays.

A fourth problem is inventory control. Lack of convenient inventory control is an important limitation of the prior art. The ability to plan new studies is impeded because no convenient standard method currently exists to track and maintain records of sample availability, volume, and concentration. Precious solution inventory management is currently in a state similar to that of major food retailers prior to the introduction of barcode-based inventory management technology.

U.S. Pat. No. 6,037,168 addresses the above-mentioned problems associated with the removal of closures from biological samples, by providing an improved releasable seal. While contamination may be thereby reduced (though not as effectively as where each sample is contained within a separate enclosure) evaporation and oxidation problems persist.

U.S. Pat. No. 5,464,396 teaches a multi-syringe assembly for the storage, mixing, and delivery of a biological multi-component material. This device suffers from at least the drawback that filling is performed by introducing the materials into the open ends of the syringes and sealing the syringes by inserting pistons. This method therefore increases the probability of contamination.

U.S. Pat. No. 6,506,610 teaches an apparatus and method for transferring liquids between receptacles with reduced risk of contamination. The apparatus has a waste chamber, a pipette tip parking chamber and at least one process chamber. However, the apparatus and method suffer from the drawback that they do not solve the problems of evaporation and oxidation because the samples are open to the air.

U.S. Pat. No. 6,357,583 teaches a rotary container for collection, transport, and dispensing of biological samples in which the samples are housed in a plurality of wells arranged in a circle and covered with a rotatable cover having a single opening. The use of this apparatus entails a significant risk of cross-contamination when the cover is moved relative to the samples. Alternatively, where a space is provided between the samples and cover to minimize cross-contamination, evaporation and oxidation may result.

Finally, U.S. Pat. Nos. 6,620,383 and 5,785,926 teach complex apparatuses for dispensing microliter or nanoliter amounts of biological materials. However, these apparatuses are not suitable for low-temperature storage or repeated cycles of freezing and thawing, and are too expensive to be practical in the long-term storage of a large number of biological samples.

In summary, current procedures for precious solution storage and dispensing, whether manual or automated, are susceptible to cross-contamination, evaporation, oxidation, and samples are difficult to track.

There is therefore a need for an improved apparatus and processes that overcome these limitations of the prior art and provide for the inexpensive storage, tracking, and dispensing of precious biologic solutions. Specifically, a need exists for a robust, reliable, and secure long-term storage and precision dispensing system for precious biologic solutions for use in life science research and molecular medicine. These advantages and more will be readily apparent to skilled in the art upon reading the following disclosure and examples.

SUMMARY OF THE INVENTION

In view of the foregoing disadvantages of known methods and devices for the long-term storage and dispensing of precious biologic liquids, it is an object of the present invention to build upon the technology available in the art, as described above, and to provide an improved system and method for the long-term storage and dispensing of precious biologic liquids.

These and other objects have been achieved by the present invention, which is based upon the idea of combining storage and precision dispensing functions into a single system in which isolation from air is robust and continuous and opportunities for contamination are minimized.

In a first aspect, the invention provides a liquid storage and dispensing system that is made of three main components. These components are, first, a preferably transparent or translucent storage barrel with a cylindrical bore and which has an open proximal end with a radial flange (with a V-cross section or equivalent to provide for automatic centering when grasped), and a closed distal end with a port that exits the storage barrel through a delivery tip. Second, a piston is provided within the storage barrel, where the piston has a handle and a distal end adapted to fit the distal end of the storage barrel, with a seal contacting the bore between the distal and proximal ends of the piston. Third, a cover for the delivery tip during storage and which seals the port from contamination and oxygen.

In a second embodiment, a liquid storage and dispensing system further comprising protective jacket for a glass storage barrel is provided that is secured to the storage barrel and which provides increase resistance to certain types of chemical degradation while also providing a window for viewing the contents of the glass storage barrel.

The liquid storage and dispensing system of the above embodiments also include labeling features that improve inventory control.

In a third embodiment, the invention provides a method for storing a liquid in the liquid storage and dispensing system of the present invention. The method includes removing the cover from the delivery tip and replacing it with a delivery tube such as a pipette tip. Next, the piston is pushed along the barrel until the distal end of the piston contacts the distal end of the barrel. Because the shapes match, dead volume is minimized. The delivery tip is inserted into the liquid and the piston pulled along the barrel toward the proximal end of the barrel filling the barrel. Once filled, the delivery tube is replaced with a replacement cover, and the liquid storage and dispensing system is stored.

In a fourth embodiment, the invention provides a method for the precise dispensing of a predetermined amount of a liquid from the liquid storage and dispensing system of the invention, the method including removing the cover from the delivery tip of a filled liquid storage and dispensing system, attaching a delivery tube to said delivery tip, and locating the tip in a receptacle. The piston is moved along the barrel toward the distal end of the barrel a predetermined distance, or responsive to the weight of the receptacle, in order to dispense a predetermined amount of the liquid into the receptacle.

By these methods, the liquid storage and dispensing system of the invention can be filled (leaving no space for air thus eliminating evaporation), stored, and used to repetitively dispense metered amounts of liquid while virtually eliminating the risks of contamination, evaporation, and oxidation.

As a fifth embodiment, a means of sensing the presence or absence of the liquid in the dispensing tip by a sensing means is provided. This sensing means provides improved control whereby the accuracy of dispensing is improved and the risk of leakage decreased. Furthermore, this design provides means to offset and calibrate piston position relative to the cylinder, especially when used after very long-term storage. In this embodiment, the motion of the piston is adjusted according to the output of said sensing means.

Thus, improved long-term storage and dispensing of precious biologic samples is enabled without the disadvantages of the prior art. Cross-contamination, evaporative loss, and oxidation of reagent is markedly reduced. The system and methods are readily adaptable to automated systems such as that disclosed in U.S. Pat. No. 6,387,330 thereby reducing human error and fatigue.

BRIEF DESCRIPTION OF THE DRAWINGS

For a better understanding of the nature and objects of the present invention, reference should be made to the following detailed description in conjunction with the accompanying drawings, in which.

DETAILED DESCRIPTION

Figure 1:
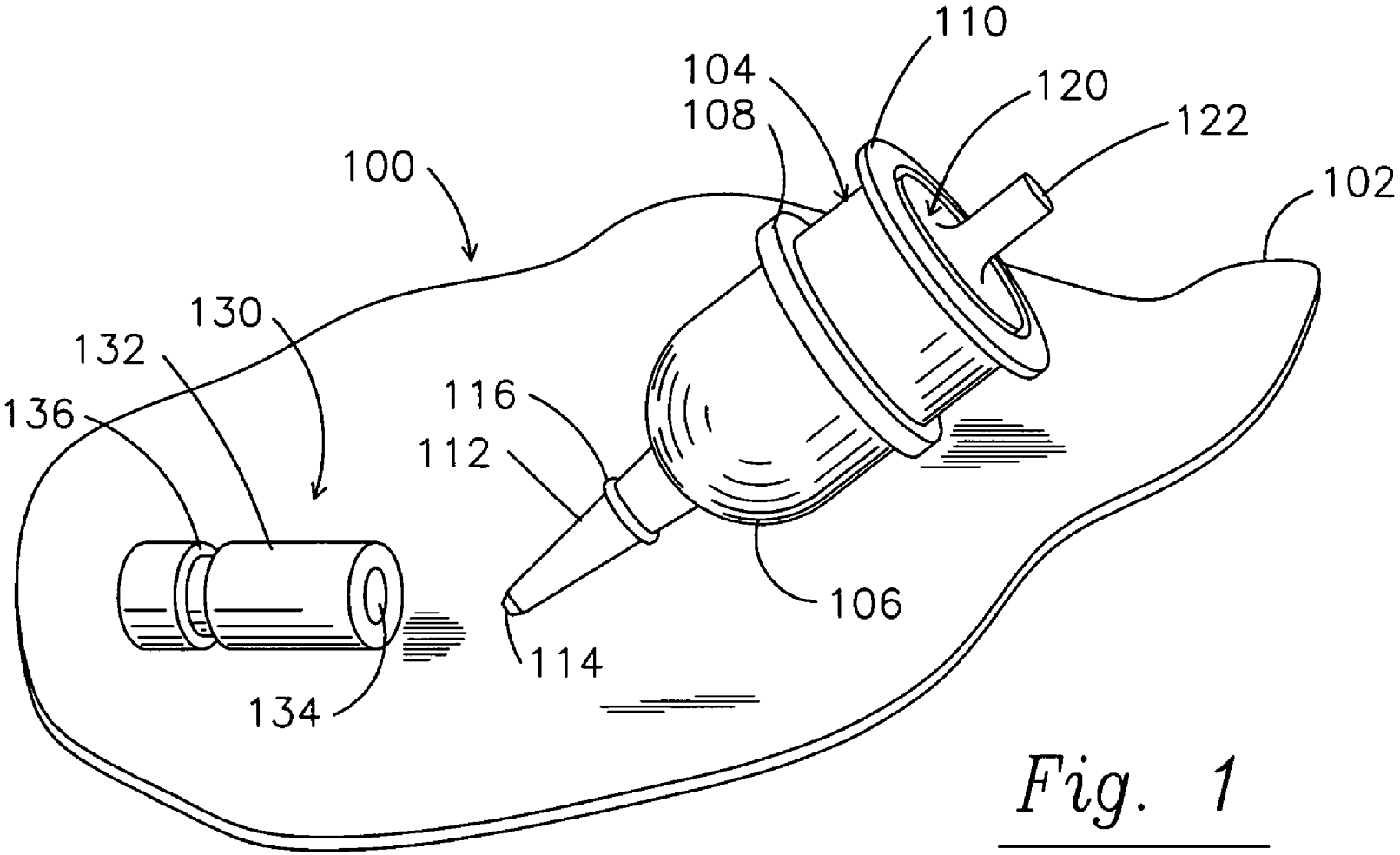
FIG. 1 is a perspective view of one embodiment of the liquid storage and dispensing system of the present invention, with the delivery tip cover detached, resting on a flat surface.

Referring now to FIG. 1, a first embodiment of the liquid storage and dispensing system (100) of the present invention is shown with the cover (130) of the delivery tip (112) detached, resting on a flat surface (102). The liquid storage and dispensing system (100) of this first embodiment comprises a storage barrel (104), a piston (120), and a cover (130).

The storage barrel (104) of this first embodiment is preferably made from a clear or translucent plastic to permit visibility of the liquid therein. The material for the storage barrel is selected based upon several preferred characteristics. The material is chosen as sufficiently dimensionally stable to withstand repeated (up to 500) cycles of freezing and thawing, where the storage temperature may be −80° C. or lower. In addition, all of the components of the liquid storage and dispensing system can withstand sterilization, for example by steam treatment at 2 atmospheres pressure and 125° C., or by ionizing or non-ionizing radiation treatments. Further, the material for the storage barrel (104) has low water porosity to minimize evaporation during prolonged storage and a low creep modulus. Suitable materials are polysulfone, polycarbonate, polypropylene, polystyrene, acrylonitrile butadiene styrene (ABS), or their equivalents. Most preferably, the material is polysulfone.

Storage barrel (104) has a proximal end comprising cylindrical bore, reflected in this embodiment in a corresponding cylindrical outer surface. The outer shape is, however, not particularly limited, except as described below. At the proximal end of the storage barrel, an outwardly radial flange (110) is provided to facilitate manual or robotic handling and to provide a reference upper surface. The dimensions of the flange are not particularly limited, and the flange can, for example, have either a rectangular or a V-shaped cross-section. A V-shaped cross-section is preferred.

The distal end (106) of the storage barrel (104) is closed except for a port that exits the distal end of the storage barrel through orifice (114) via delivery tip (112). The delivery tip is preferably tapered to accept a Luer-type fitting such as a pipette tip of a type that is well-known in the art. However, it is not required that the delivery tip be tapered.

Piston (120) is slideably disposed within the cylindrical bore of the storage barrel (104). The piston is made from the same materials listed above for the storage barrel or their equivalents. However, the piston need not be clear or translucent. Accordingly, other materials such as PEEK, Teflon, or an equivalent, are used. PEEK is preferred. At its proximal end, the piston comprises a handle (122) for grasping by an actuator, such as the automated or robotic actuator disclosed in U.S. Pat. No. 6,387,330. In this embodiment, the handle is axially located and has a cylindrical shape and a circular cross-section adapted for grasping by a collet actuator. However, many shapes of handle will be readily apparent. In use, the handle is grasped by an actuator to effect filling and dispensing by translating the piston towards the proximal and distal ends of the storage barrel, respectively.

The delivery tip (112) is adapted to engage cover (130) and to seal orifice (114). In the present embodiment, the cover has a cylindrical outer surface (132) and comprises a bore (134) that engages delivery tip (112). Optionally, delivery tip (112) further comprises a delivery tip ridge (116) that engages a cover groove (140, FIG. 2) located within the bore (134) to secure the cover to the tip.

The material of the cover may be of any rigid or semi-rigid material capable of retaining dimensional stability under sterilization and repeated cycles of freezing and thawing of the system contents, such as a plastic or rubber. Molded translucent polypropylene is preferred.

Cover (130) is optionally further adapted to accept a tool for stripping the cover from the tip. In this embodiment, recess (136) is provided for this purpose.

Figure 2:
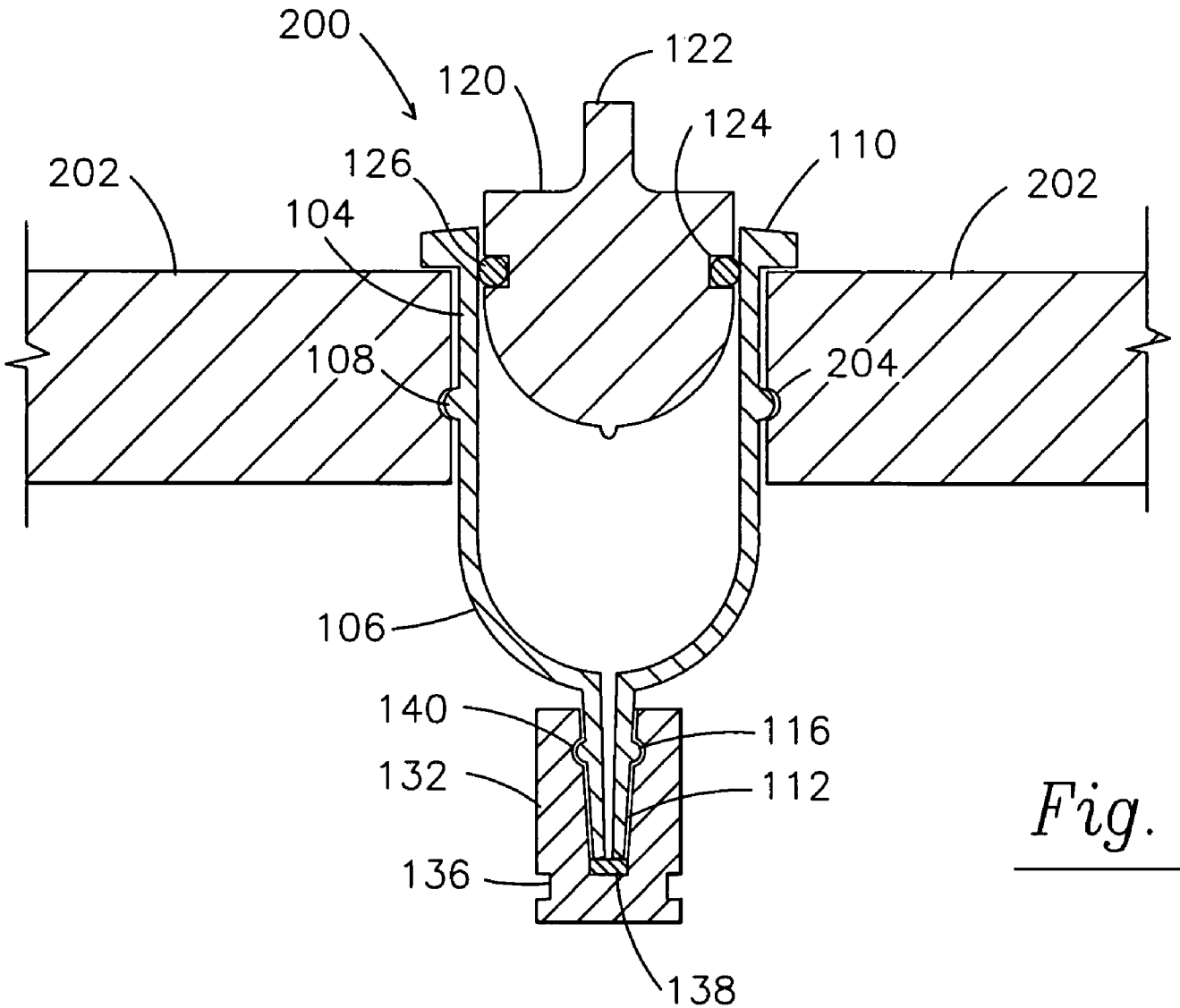
FIG. 2 is a cross-sectional view of one embodiment of the liquid storage and dispensing system of the present invention, stored in a rack.

Turning now to FIG. 2, there is shown a cross-sectional view of the embodiment of FIG. 1 of the liquid storage and dispensing system of the present invention stored in a rack (200). A rack (202) is adapted to securely retain a plurality of the liquid storage and dispensing systems of FIG. 1 against vibration and spillage. Preferably, a rack comprising an array of 8×12 liquid storage and dispensing systems is used in order to match the format of microtiter plates well-known in the art and facilitate experimental design. The racks are preferably designed to optimize space utilization by optimizing suitable ratios such as the ratio of liquid volume stored to rack volume, the ratio of liquid volume stored to shelf volume used, and the like. Racks that lock or engage each other are preferred in order to further minimize the risk of dropping, spillage, or cross-contamination. Preferably, the rack is designed to maintain the same specific orientation of each liquid storage and dispensing system stored therein so that all labels can be read at once from a single direction. Visual cues that can be included in the design of the rack to ensure the correct orientation of the rack while in use will readily occur to one of skill in the art. Further, a single rack cover, or a plurality of individual piston covers can be used to protect the pistons from accidental movement during transport or storage in the rack. A temperature indicating strip or other temperature indicator, such as a dummy liquid storage and dispensing system comprising a temperature sensor, is preferably located on or in one or more racks to permit monitoring of the temperature of the liquids stored therein. Storage barrel ridge (108) engages rack groove (204) to secure the liquid storage and dispensing system in the rack. This feature prevents the systems stored in a rack from rattling or vibrating. In addition, in the event of the rack being dropped, the likelihood of spillage is reduced. Similarly, delivery tip ridge (116) engages cover groove (140) to secure the cover (130) to the delivery tip (112). The dimension of the rack openings are selected so that the system rests upon the upper surface of the rack by outwardly radial flange (110).

Piston (120) has a proximal and a distal end. The distal end is chosen to match the shape of the distal end of the storage barrel (116) so that, when the piston is translated distally to its maximum extent, it contacts the distal surface of the bore such that liquid dead volume is minimized. In this embodiment, the distal ends of the piston and bore are hemispherical, which is preferred. However, other shapes, such as coni, are possible provided that dead-volume of liquid is minimized by selection of matching shapes.

Between the proximal and distal ends of the piston, a circumferential seal (126) is provided. The seal is preferably retained within piston groove (124) and presses against the inner surface of the storage barrel bore, whereby the liquid within the bore is retained and entry of air minimized. The embodiment of FIGS. 1 and 2 show an O-ring seal (126). However, a quad ring (or X-ring) two point seal is preferred. The material of the seal is an elastomer selected on the basis of chemical compatability with the contained liquid and thermal compatability with the piston and storage barrel. In particular, the dimension of piston groove (124) is matched to the dimensions and material of the seal in accordance with known hydrodynamic principles. A preferred material is suitable for low temperature use to ensure that the seal is maintained during low temperature storage; has low compression set or creep; has low stress relaxation and a high retained sealing force; is resilient; and has a low coefficient of friction for ease of piston operation. Preferred materials include neoprene, fluorocarbon (Viton), buna nitrile, fluorosilicone, Teflon, polyurethane, ethylene propylene, Aegis, Aflas, and equivalents.

Optionally, a septum (138) is provided within the bore of cover (130), which provides improved sealing of orifice (114). The septum is made of a rubber or elastomer. Most preferably, septum (138), cover groove (140), and delivery tip ridge (116) cooperate so that the engagement of septum (138) and cover groove (140) pushes septum (138) tightly against the orifice (114) to effect a tight seal.

The contained volume of the liquid storage and dispensing systems is not particularly limited within the mechanical limitations of construction, and the volume may be selected accordingly. However, within the context of molecular biological screening, preferred dimensions emerge. The maximum volume of liquid that the liquid storage and dispensing system of the present invention can contain is preferably between about 0.5 mL and about 20 mL. About 1 mL is preferred. It will be readily appreciated that a range of bore diameters and lengths may be used for a given liquid volume. However, for a volume of 1 mL, a bore diameter of about 11 mm is preferred.

The diameter of the port is selected based upon considerations of filling and dispensing speed, dispensing precision, and the head pressure required to dispense the liquid. Too high a head pressure can result in shearing of sensitive biomolecules such as DNA and RNA. A diameter from about 0.25 mm to about 1 mm is preferred.

Figure 3:
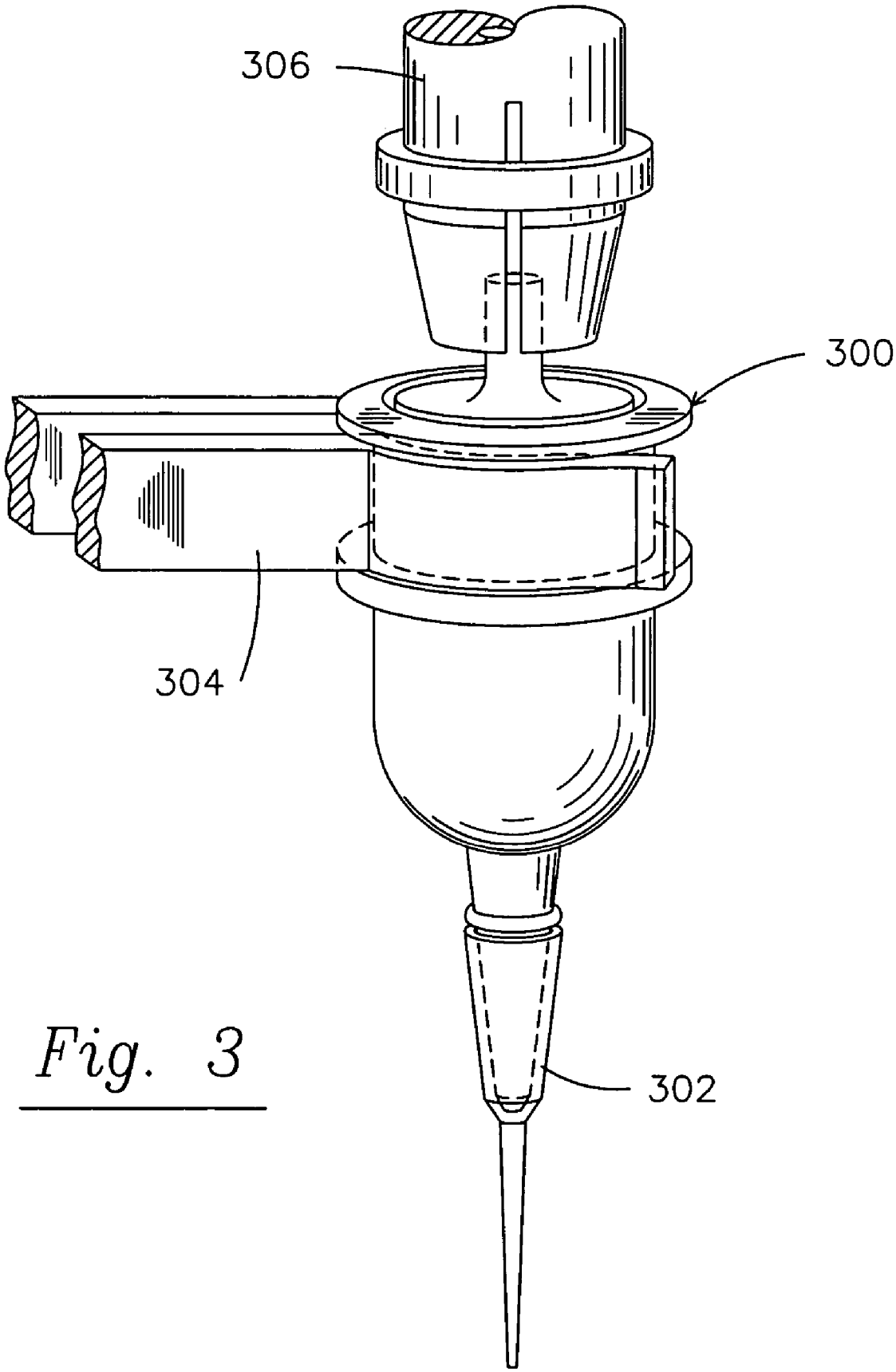
FIG. 3 is a perspective view of one embodiment of the liquid storage and dispensing system of the present invention, retained in container gripper with a piston actuator attached.

Referring now to FIG. 3, the embodiment of the liquid storage and dispensing system of FIGS. 1 and 2 is shown retained in a container gripper (304) with a piston actuator (306) and delivery tube (302) attached. The container gripper (304) and piston actuator (306) are described, for example, in U.S. Pat. No. 6,387,330, which is incorporated by reference herein. Preferably, as shown in FIG. 3, the delivery tube is a Luer-type pipette tip, which is well-known in the art. Positioning the liquid storage and dispensing system relative to a receptacle or liquid source is achieved by translations of the container gripper (304) in the x, y and z directions under computer control. Translation of the piston by the piston actuator (306) in the longitudinal axis relative to the container gripper (304), also under computer control, results in uptake or dispensing of the liquid.

Figure 4:
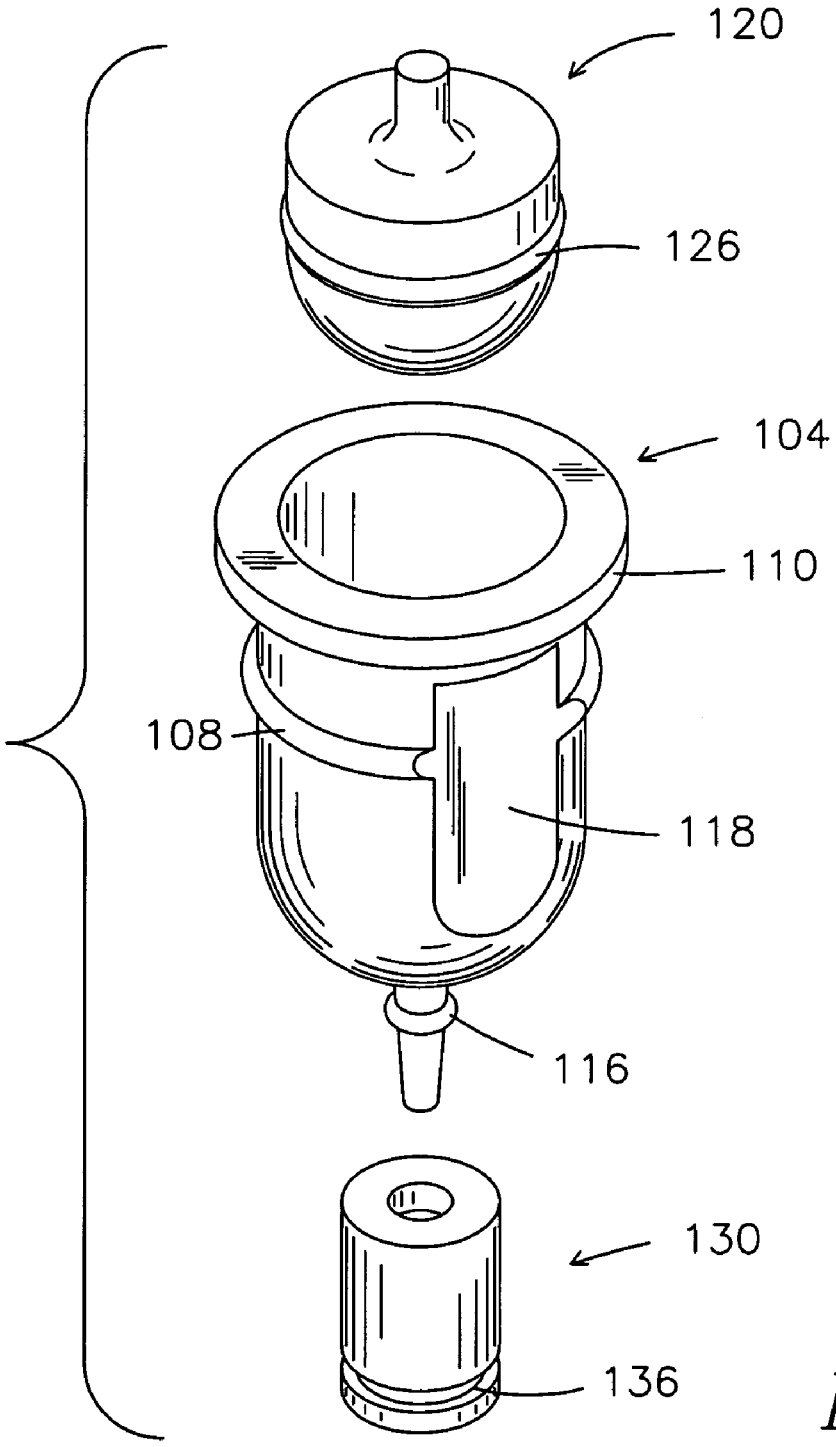
FIG. 4 is an exploded view of one embodiment of the liquid storage and dispensing system of the present invention.

Referring now to FIG. 4, an exploded view of a modified embodiment of the liquid storage and dispensing system of FIGS. 1-3 is shown. In this embodiment, a planar portion (118) of the external surface of the storage barrel (104) is provided, and is used to label the liquid storage and dispensing system with, a bar code, radio-tag, writing, or the like, providing information on the contents of the system to an operator. Also, in this embodiment, ridge (108) extends only about a portion of the circumference of the storage barrel.

Figure 5:
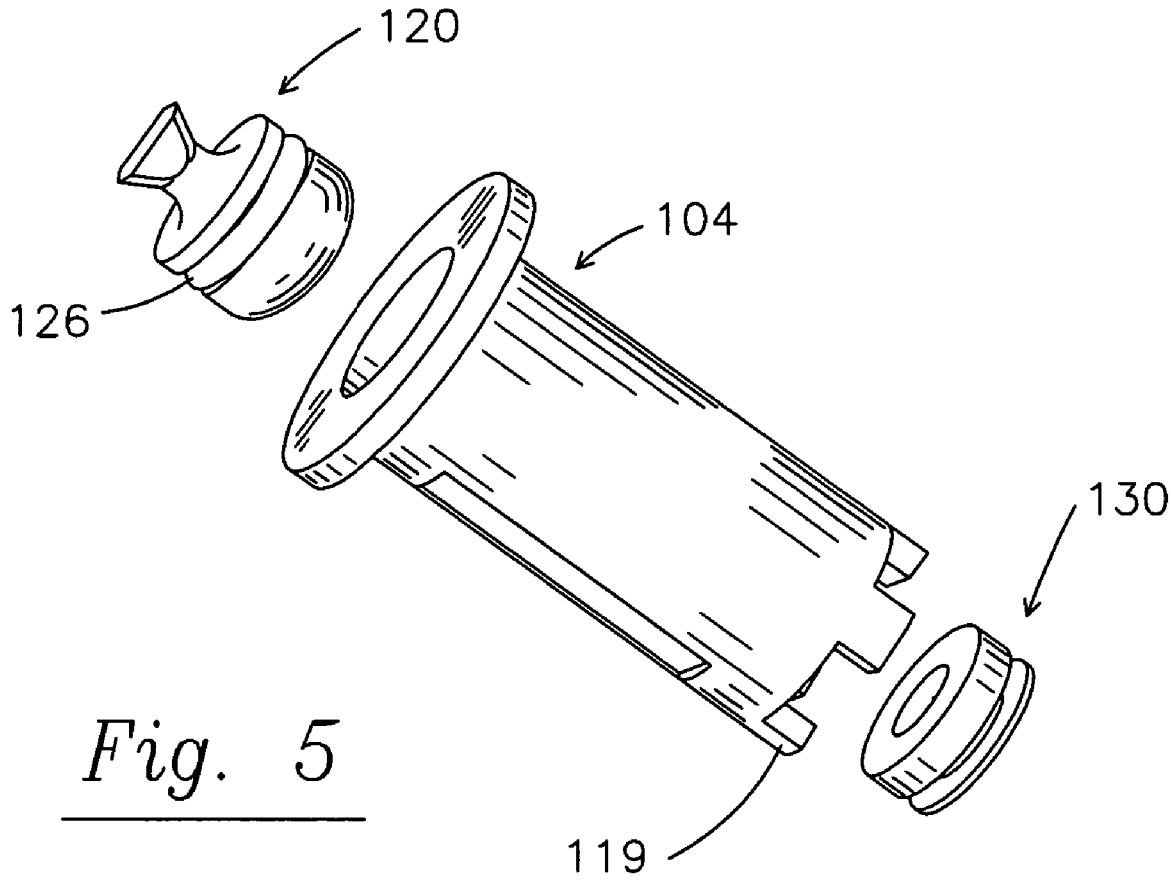
FIG. 5 is an exploded view of a second embodiment of the liquid storage and dispensing system of the present invention.

FIG. 5 is an exploded view of a second embodiment of the liquid storage and dispensing system of the present invention. This embodiment lacks optional raised portion or ridge (108) of the previous embodiments. A plurality of tabs (119), preferably 2-4, is provided to further secure, by a snap-fit, the cover (130) to the delivery tip, which in this embodiment is recessed.

Figure 6:
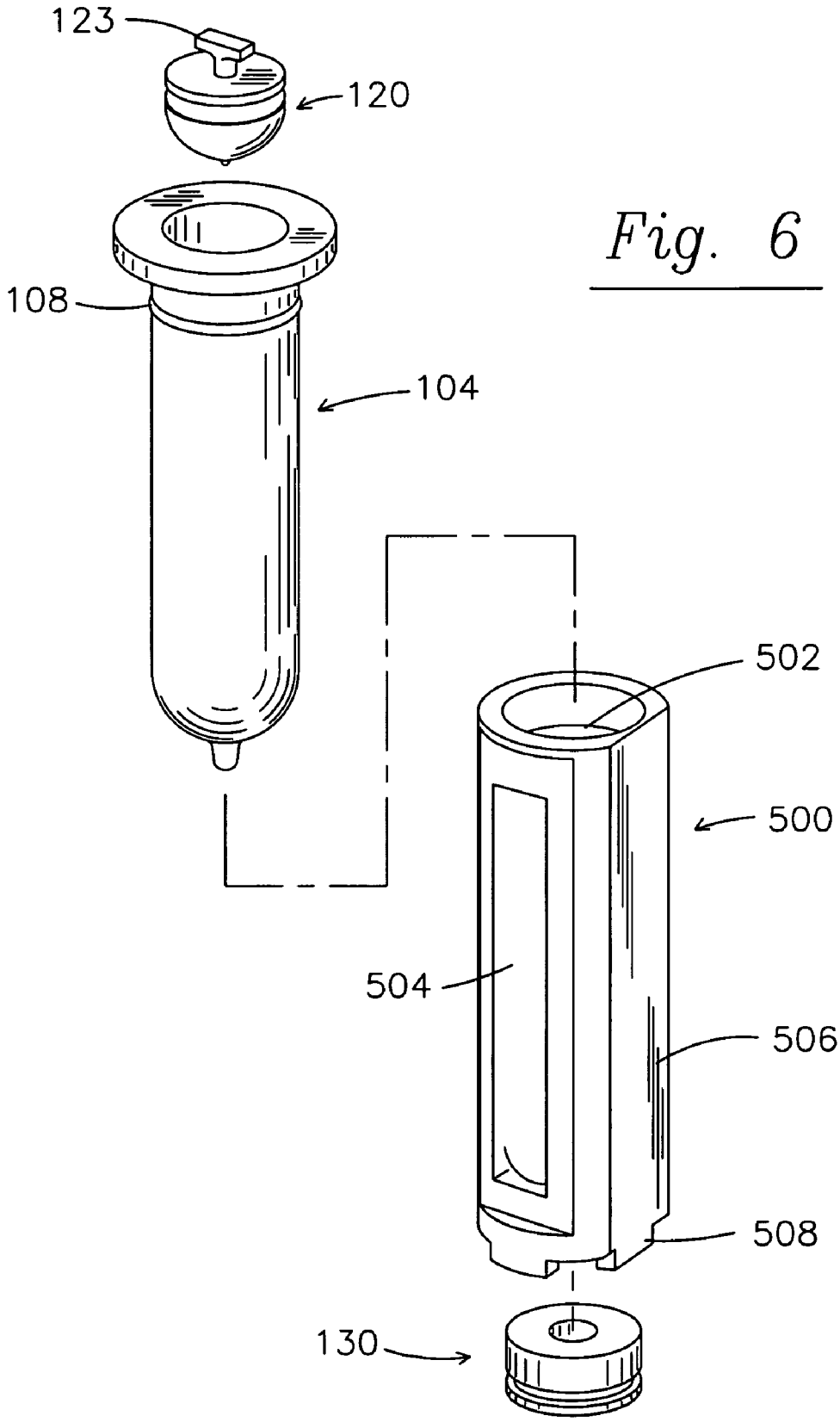
FIG. 6 is an exploded view of a third embodiment of the liquid storage and dispensing system of the present invention.

FIG. 6 is an exploded view of a third embodiment of the liquid storage and dispensing system of the present invention further comprising a protective jacket (500) that substantially encloses the storage barrel. In applications where minimizing oxygen and water diffusion through the storage barrel is critical, a glass storage barrel (104 of FIG. 6) is preferred. In this embodiment, the protective jacket is preferred in order to protect the glass storage barrel from mechanical damage. The material of the protective jacket may be the same as for the storage barrels of the first two embodiments herein. The glass of the storage barrel of the present embodiment may be a standard clear glass such as Type 1, Class B borosilicate. The protective jacket comprises a window (504) to facilitate viewing the contents of the storage barrel, and the storage barrel can comprise volumetric markings. An interior groove (502) is provided to engage ridge (108) and secure the protective jacket to the storage barrel. A planar portion of the protective jacket (506) provides a labeling surface. Optionally, a small longitudinal slit from the groove to the proximal end of the protective cover facilitates assembly of the storage barrel within the protective cover. The protective jacket comprises protective cover tabs (508) and this embodiment has a T-bar handle (123).

The use of the liquid storage and dispensing system of the present invention will now be described.

The liquid storage and dispensing system is preferably sterilized with the piston located at the proximal end of the storage barrel. At the time of use, the cover is removed, a pipette tip is attached and the piston is fully translated to the distal end of the storage barrel. Liquid is drawn into the barrel through the pipette tip by translation of the piston towards the proximal end of the barrel. After filling the barrel with the liquid, the pipette tip is replaced with a cover and the liquid storage and dispensing system is stored in racks designed for this purpose (FIG. 2).

The dispensing of the liquid from a liquid storage and dispensing system comprises the following operations, which may be automated according to the methods and devices disclosed in U.S. Pat. No. 6,387,330. The liquid storage and dispensing system is picked from a rack (FIG. 2) by a container gripper. The container gripper holds the liquid storage and dispensing system using the flange for alignment with the axis of the liquid storage and dispensing system. The cover is removed by orienting the liquid storage and dispensing system with the cover recess (136) between two fixtures and lifting the liquid storage and dispensing system to remove the cover. The piston is moved down with the help of the collet actuator until the liquid arrives at the orifice. Optionally, a sensor, which may be optical, electrochemical, conductimetric, or the like, in its principle of operation is provided to sense the presence or absence of liquid in the dispensing tip, and is used to stop piston motion and to provide a zero reference for subsequent dispensing purposes. Once the zero reference is defined, the xyz table positions the delivery tip over the correct receptacle. The required amount of the liquid is dispensed into the receptacle by moving the piston downwards with the help of the actuator. Once the required amount of liquid is dispensed, the liquid is optionally retracted a small distance (approximately 1 mm) into the dispensing tip to avoid dripping during motion.

LISTING OF THE NUMERALS

100 liquid storage and dispensing system
102 flat surface
104 storage barrel
106 distal end of storage barrel
108 storage barrel ridge
110 outwardly radial flange
112 delivery tip
114 orifice
116 delivery tip ridge
118 planar portion of storage barrel
119 storage barrel tab
120 piston
122 handle
123 T-bar handle
124 piston groove
126 seal
130 cover

132 cylindrical outer surface
134 bore
136 recess
138 septum
140 cover groove
202 rack
204 rack groove
302 delivery tube
304 container gripper
306 piston actuator
500 protective jacket
502 interior groove
504 window
506 planar portion of protective jacket
508 protective cover tab With respect to the above description, it is to be understood that the optimum dimensional relationships for the parts of the invention, to include variations in size, materials, shape, form, function, and manner of operation, assembly, and use, are deemed readily apparent to one skilled in the art, and all equivalent relationships to those illustrated in the drawings and described in the specification are intended to be encompassed by the present invention.

Therefore, the foregoing is considered to be illustrative only of the principles of the invention. Further, as numerous modifications and changes will readily occur to those skilled in the art, it is not desired to limit the invention to the exact construction shown and described, and accordingly, all suitable modifications and equivalents may be resorted to, falling within the scope of the invention.

Now that the invention has been described:

What is claimed is:

1. A liquid storage and dispensing system comprising:

(a) a storage barrel including a cylindrical bore having an open proximal end and a closed distal end having a port, wherein the port exits the storage barrel through a delivery tip;

(b) a piston slideably disposed within the storage barrel, the piston having a proximal end with a handle, a distal end adapted to fit the distal end of the storage barrel, and a seal contacting the bore and disposed about the circumference of the piston between the distal and proximal ends of the piston;

(c) a cover adapted to engage the delivery tip and seal the port; and (d) a sensing means adapted to sense the presence or absence of liquid in or on the delivery tip for adjusting motion of the piston according to an output of the sensing means.

2. The liquid storage and dispensing system according to claim 1, wherein the distal end of the storage barrel and the distal end of the piston are essentially hemispherical.

3. The liquid storage and dispensing system according to claim 1, wherein the external surface of the barrel further comprises a raised portion disposed between the proximal and distal ends of the barrel to facilitate storing and automatic handling.

4. The liquid storage and dispensing system according to claim 3, wherein said raised portion is a ridge extending about at least a portion of the circumference of the external surface of the barrel.

5. The liquid storage and dispensing system according to claim 1, wherein the external surface of the barrel further comprises a planar portion disposed between the proximal and distal ends of the barrel.

6. The liquid storage and dispensing system according to claim 1, wherein the handle is a T-bar, a rod, or a combination thereof.

7. The liquid storage and dispensing system according to claim 1, wherein the handle is a rod disposed along the longitudinal axis of the storage barrel.

8. The liquid storage and dispensing system according to claim 1, wherein the delivery tip comprises means for engaging and retaining the cover.

9. The liquid storage and dispensing system according to claim 8, wherein said means for engaging and retaining the cover is a ridge extending about the circumference of the external surface of the delivery tip.

10. The liquid storage and dispensing system according to claim 1, wherein the cover is adapted to engage a tool for removing the cover from the delivery tip.

11. The liquid storage and dispensing system according to claim 10, wherein the cover comprises a circumferential groove for engaging the tool for removing the cover from the delivery tip.

12. The liquid storage and dispensing system according to claim 3, further comprising an essentially cylindrical protective jacket having an open proximal and a distal end, and wherein the proximal end of the protective jacket slidingly engages at least a portion of the external surface of the storage barrel.

13. The liquid storage and dispensing system according to claim 12, wherein the protective jacket comprises an aperture for viewing the storage barrel.

14. The liquid storage and dispensing system according to claim 12, wherein a recess in the protective jacket slidingly engages and retains the raised portion of the container.

15. The liquid storage and dispensing system according to claim 12, wherein the protective jacket comprises an exterior planar portion disposed between the proximal and distal ends of the jacket.

16. The liquid storage and dispensing system according to claim 1, wherein a cavity defined by the piston and cylindrical bore with the piston seal adjacent the proximal end of the barrel has a volume between about 0.5 mL and about 20 mL.

17. The liquid storage and dispensing system according to claim 16, wherein said volume is between about 0.5 mL and about 2 mL.

18. A method for dispensing a predetermined amount of a liquid, the method comprising:

(a) providing a storage and dispensing system according to claim 1 comprising a stored liquid;

(b) removing a first cover from the delivery tip and attaching a delivery tube to said delivery tip and locating the tip in a receptacle;

(c) sliding the piston along the barrel toward the distal end of the barrel a predetermined distance or responsive to the weight of the receptacle, whereby a predetermined amount of the liquid is dispensed; and (d) sensing the presence or absence of the liquid in the delivery tip by the sensing means and adjusting the motion of the piston according to the output of the sensing means.

19. The liquid storage and dispensing system according to claim 1, further comprising an outwardly radial flange provided at the proximal end of the storage barrel.

20. The liquid storage and dispensing system according to claim 19, wherein the outwardly radial flange is V-shape or equivalent, capable of providing automatic centering when grasped.

* * * * *